US007927179B2

(12) United States Patent
Kaye

(10) Patent No.: US 7,927,179 B2
(45) Date of Patent: Apr. 19, 2011

(54) NON-SLIP STRAP FOR AN UNDERGARMENT

(75) Inventor: Joanne Kaye, New York, NY (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 574 days.

(21) Appl. No.: 11/767,977

(22) Filed: Jun. 25, 2007

(65) Prior Publication Data

US 2008/0032599 A1 Feb. 7, 2008

Related U.S. Application Data

(60) Provisional application No. 60/835,181, filed on Aug. 2, 2006.

(51) Int. Cl.
*A41C 3/00* (2006.01)

(52) U.S. Cl. ..... 450/86; 450/268; 450/338

(58) Field of Classification Search ..... 450/88, 450/86, 1; 2/267, 268, 310–312, 326–333, 2/338, 1; 224/264, 660, 642, 643, 265, 266, 224/254

See application file for complete search history.

(56) References Cited

U.S. PATENT DOCUMENTS

| | | | | | |
|---|---|---|---|---|---|
| 1,631,694 | A * | 6/1927 | Rick | 224/264 |
| 3,873,403 | A * | 3/1975 | Edelman | 428/111 |
| 4,795,400 | A * | 1/1989 | Greenberg | 450/86 |
| 5,155,869 | A | 10/1992 | Ralli et al. | 2/268 |
| 5,165,113 | A | 11/1992 | Hyams et al. | 2/268 |
| 5,201,078 | A * | 4/1993 | Melton | 2/268 |
| 5,240,538 | A | 8/1993 | Hyams et al. | 156/245 |
| 5,474,487 | A * | 12/1995 | Roush et al. | 450/86 |
| 5,507,681 | A * | 4/1996 | Smith et al. | 450/86 |
| 5,803,792 | A * | 9/1998 | Roush et al. | 450/86 |
| 5,885,910 | A | 3/1999 | Graichen | 442/101 |
| 5,984,762 | A * | 11/1999 | Tedeschi et al. | 450/86 |
| 6,634,923 | B2 * | 10/2003 | Waitz | 450/86 |
| 7,086,926 | B2 * | 8/2006 | Falla | 450/93 |
| 7,147,538 | B2 * | 12/2006 | Cano | 450/86 |
| 2004/0259469 | A1 | 12/2004 | Cano | 450/86 |
| 2005/0097658 | A1 | 5/2005 | Lyons et al. | 2/267 |
| 2005/0101222 | A1 | 5/2005 | Cope | 450/1 |

* cited by examiner

*Primary Examiner* — Gloria Hale

(74) *Attorney, Agent, or Firm* — Womble Carlyle Sandridge & Rice, PLLC

(57) ABSTRACT

A brassiere shoulder strap has a layer of strap material having an inner surface with an inner surface area shape and an outer non-slip surface, and a support fabric having an inner surface and overlying the inner surface of the layer of strap material. The inner surface of the support fabric corresponding to the inner surface area shape of the layer of strap material. Folded free side edges of the layer of strap material and the support fabric are all stitched together to interconnect the layer of strap material to the support fabric.

17 Claims, 7 Drawing Sheets

NON-SLIP STRAP FOR AN UNDERGARMENT

This application claims the benefit of U.S. Provisional Patent Application Ser. No. 60/835,181, filed on Aug. 2, 2006, the contents of which are incorporated by reference herein.

BACKGROUND OF THE INVENTION

1. Field of the Invention

The present invention relates generally to a non-slip strap for an article of clothing. More particularly, the present invention relates to a non-slip shoulder strap for an article of clothing. Still more particularly, the present invention relates to a non-slip shoulder strap for a brassiere in which the strap material prevents the strap from slipping on the shoulder of the wearer.

2. Description of Related Art

Undergarments often have straps that contact the shoulder of the wearer for support during wear. The shoulder straps are often connected to the cups of the undergarment and are used to maintain the position of the undergarment during wear. These straps generally have a width that maximizes their ability to maintain position on the shoulder yet not appear unsightly beneath clothing. Unfortunately, such straps do not maintain their position and do not offer comfort to the wearer.

Some brassiere straps incorporate films on their body contacting layer to maintain their position on the shoulder of the wearer. Such straps are often very thin and may not be effective after extended periods of time. Other straps have large foam inserts that are either inserted or built-in foam components that are molded or formed in the brassiere strap. Foam straps are often too bulky to be worn with close fitting over clothes. Further they can shift during wear and make the wearer self conscious or fail after several washings.

Accordingly, there is a need for a foam or fabric strap that prevents sliding of the strap on the shoulder and that offers a smooth profile beneath clothing and provides desired comfort during wear.

SUMMARY OF THE INVENTION

The present disclosure provides for a brassiere strap having a foam layer that directly contacts the shoulder of the wearer to prevent sliding.

The present disclosure also provides for a brassiere strap having a fabric layer that directly contacts the shoulder of the wearer to prevent sliding.

The present disclosure also provides for a brassiere strap having a material layer with a nap that directly contacts the shoulder of the wearer to prevent sliding of the strap over the shoulder during wear.

The present disclosure further provides for a brassiere strap having a foam body contacting layer with a curvilinear and/or straight configuration that does not slide or shift on the shoulder during wear.

The present disclosure still further provides for a brassiere strap having a skin contacting layer that is knitted to prevent slippage against the skin of the wearer.

The present disclosure still yet further provides for a brassiere strap that has a comfort feature and a non-slip body contacting layer.

The present disclosure yet still further provides for a brassiere strap having a foam layer that contacts the shoulder of the wearer that distributes pressure over the shoulder.

The present disclosure also provides for a brassiere strap that has any one of a gel, a spacer fabric or a fiber fill insert therein and a non-slip body contacting layer.

The present disclosure further provides for a brassiere strap that has a width from about ⅜ inches to 1¼ inches in width and a non-slip body contacting layer.

These and other advantages and benefits are provided by a brassiere strap having a layer of material having an inner surface and a non-slip surface, and a support fabric connected to the inner surface. The non-slip surface has a nap that is capable of preventing movement between the non-slip surface and the skin of a wearer when the strap is worn against the skin of the wearer.

The present disclosure further provides a brassiere strap having a layer with a non-slip surface and an inner surface opposite the non-slip surface. The support layer is connected to the inner surface. The non-slip surface is formed from a material having a nap that is capable of preventing movement between the non-slip surface and the skin of the wearer when the strap is worn against the skin of a wearer.

BRIEF DESCRIPTION OF THE DRAWINGS

These and other objects of the present invention will be more apparent from the following detailed description of the present invention, in conjunction with the accompanying drawings wherein.

DETAILED DESCRIPTION OF THE INVENTION

Figure 1:
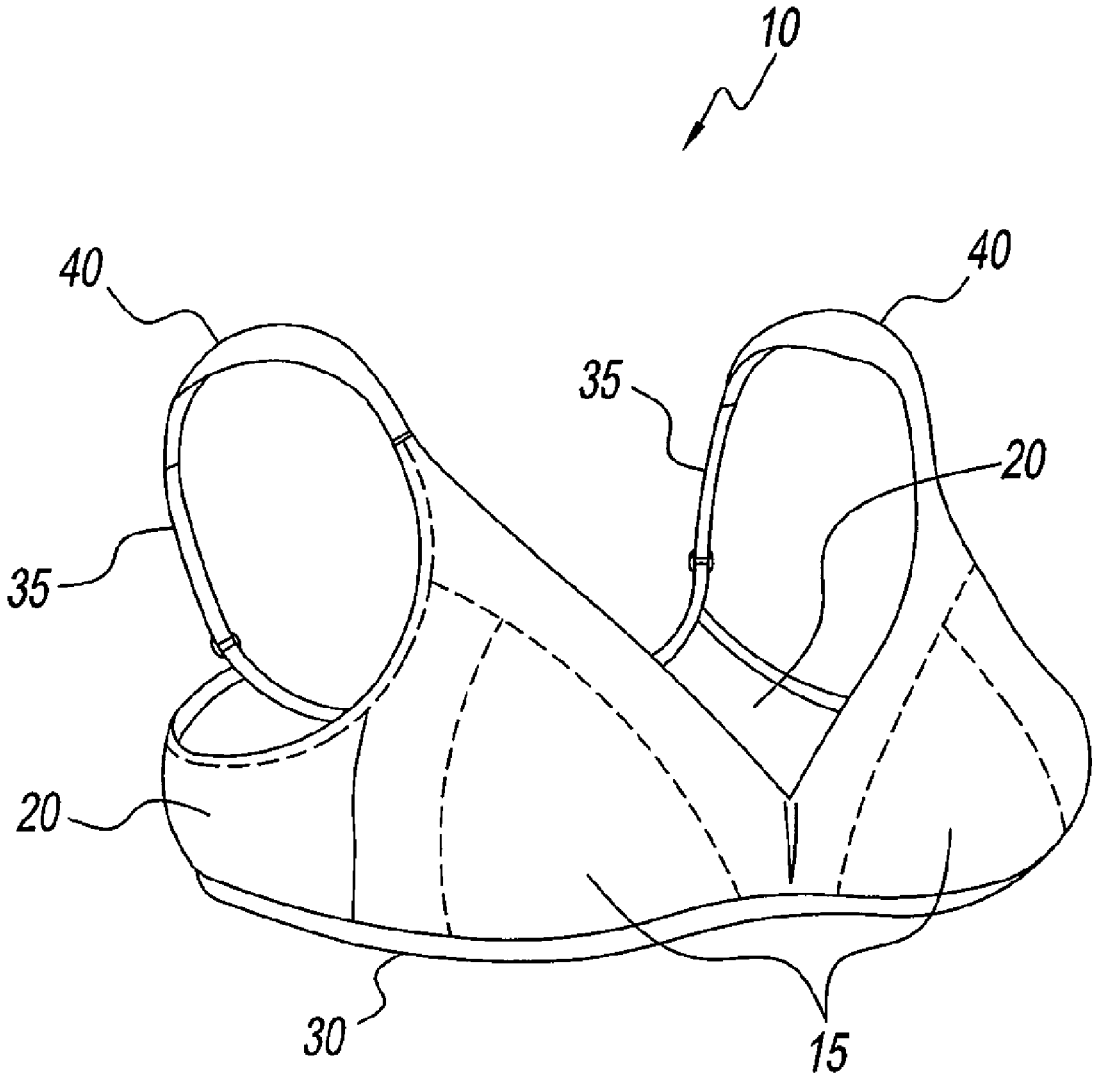
FIG. 1 illustrates a perspective view of a brassiere that incorporates the foam straps of the first embodiment of the present invention.

Referring to the drawings, and in particular, FIG. 1, there is provided a brassiere generally represented by reference numeral 10. Brassiere 10 is shown as a conventional brassiere and includes a pair of breast-receiving cups 15, a torso-encircling band 30 and a pair of back panels 20. Each shoulder strap 40 is connected to one of the pair of breast receiving cups 15 and to one of a pair of adjustable back strap assemblies 35. Each shoulder strap 40, as shown more clearly in FIGS. 2 and 3 has a shaped area with a non-slip portion 55.

Figure 2:
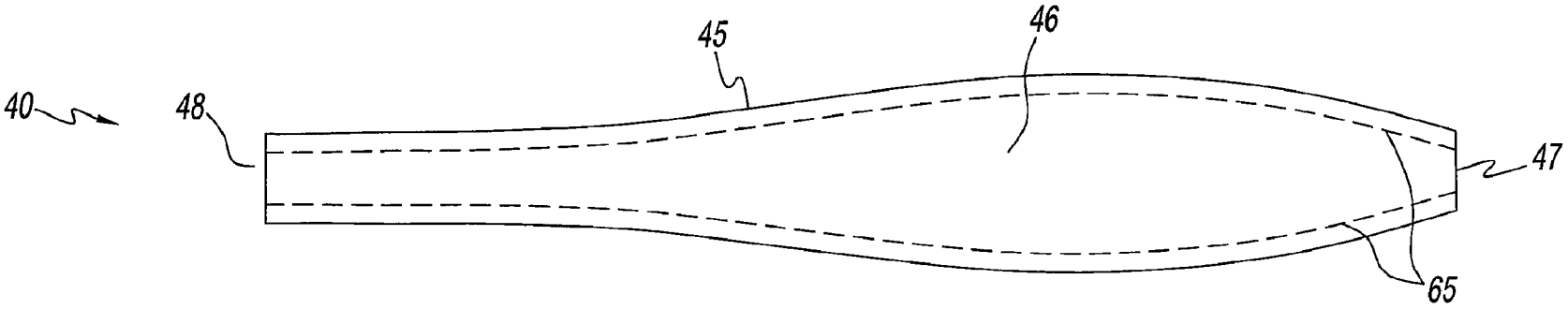
FIG. 2 illustrates a top view of the foam straps of FIG. 1 of the present invention.
Figure 3:
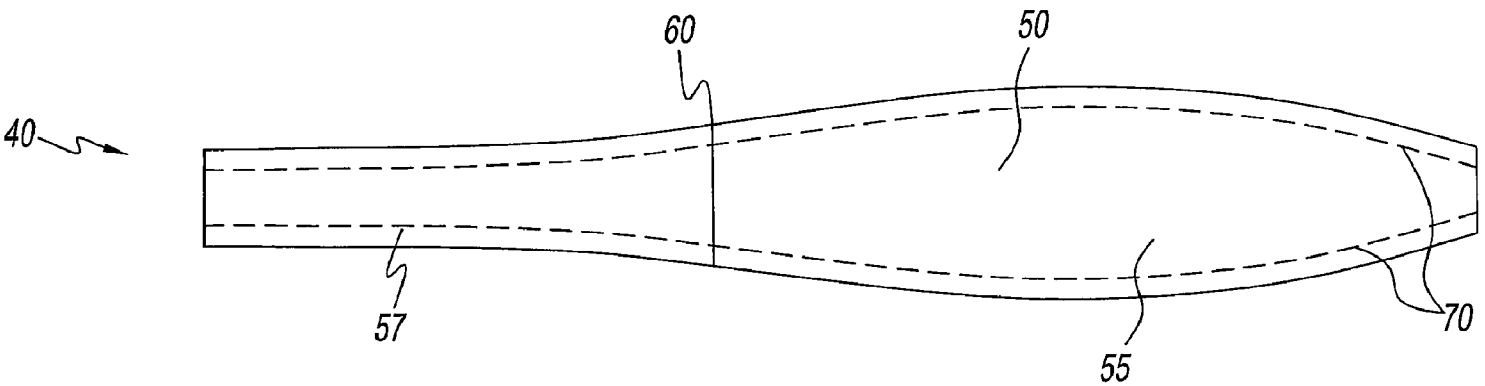
FIG. 3 illustrates a bottom view of the foam straps of FIG. 1 of the present invention.
Figure 4:
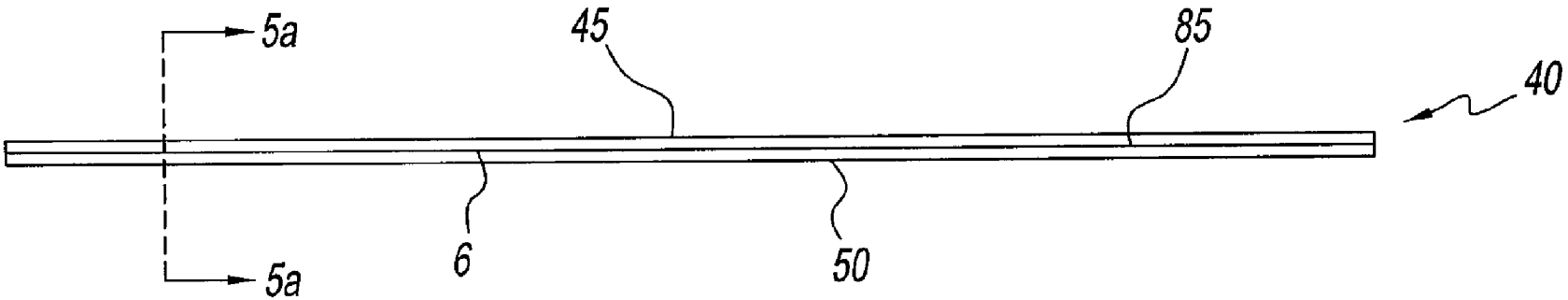
FIG. 4 illustrates a side view of the foam straps of FIG. 1 of the present invention.

Referring to FIGS. 2 through 4, a first embodiment of the strap 40 of the present invention is shown. Strap 40 has an upper support layer 45 having a surface 46 and lower layer 50, respectively. Strap 40 has a front end 48 that is connected proximate the breast cup of brassiere 10 and a back end 47 that is connected to a strap assembly 35 of brassiere 10. Strap assembly 35 has a strap adjustment element to change the length of the strap. Alternatively, the adjustment feature could be located at the front of brassiere 10. Upper support layer 45 has a very smooth profile to ensure a smooth appearance beneath clothing. Upper support layer 45 is made from a smooth fabric such as, for example, polyester, although other materials could also be used. Lower layer 50 is made from two materials, a non-slip foam portion 55 and a smooth portion 57. Smooth portion 57 can be made from the same material as upper support layer 45.

Non-slip foam portion 55 contacts the skin of the wearer during wear of brassiere 10. Non-slip foam portion 55 is made from a material that has a nap and provides a degree of friction between itself and the skin of the wearer. Non-slip foam portion 55 is preferably made from a soft foam material such as a material called PORON™, that is owned by Rogers Corporation. Poron™ is an open celled microcellular polyurethane that is a urethane polymer. Non-slip foam portion 55 has a sueded or buffed texture that ensures strap 40 will not slide or move from the shoulder of the wearer during wear. Other materials similar to PORON™ that offer a similar textured surface that would resist sliding on the shoulder of the wearer could also be used.

Layers 45 and 50 of strap 40 have a curvilinear shape, for example, an elongated ovoid shape that is widest at the non-slip foam portion 55. Non-slip foam portion 55 is advantageously positioned at the top of the shoulder to resist slipping or shifting on the shoulder during wear and active movement. Thus, the broad non-slip foam portion 55 is provided where it is particularly necessary to offer the greatest amount of foam material to effect the non-slip function. Layers 45 and 50 each contain stitching 65 and 70, respectively, to connect layers 45 and 50.

Referring to FIG. 4, the profile of brassiere strap 40 and upper support layer 45 and lower layer 50 are shown. Strap 40 has a smooth profile even though a foam material is used in its assembly. In many brassieres, a foam strap feature adds unwanted bulk to the strap and a visible contour beneath clothing. By having the non-slip foam portion 55 as a skin contacting surface, that disadvantage is eliminated.

Figure 5A:
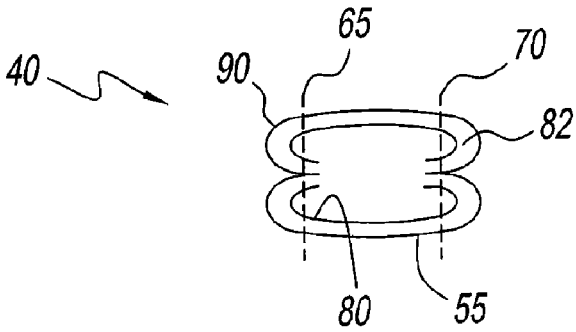
FIG. 5*a* illustrates a side cross-sectional view of the foam strap according to FIG. 4 of the present invention taken along line 5*a*-5*a;*
Figure 5B:
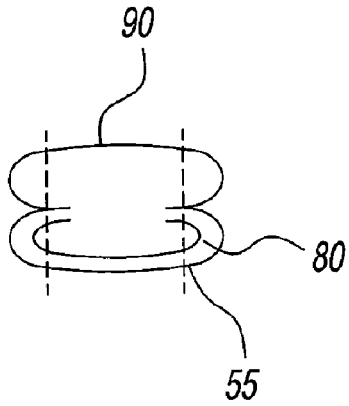
FIG. 5*b* illustrates a side cross-sectional view of the foam strap of FIG. 4 without a laminated layer of FIG. 5*a;*

FIG. 5*a* shows the cup fabric 90 of brassiere strap 40 having an inner layer of netting material layer 82. Similarly, the inner side of non-slip layer 55 is also covered by a netting material layer 80 such as for example, stabilized microfiber or stabilized tricot. Netting material layers 80 and 82 are laminated to the non-skin contacting layer of non-slip portion 55 and inner cup fabric layer 90 prior to strap assembly. Netting material 80 allows non-slip layer 55 to be sewn to create seams 65 and 70 without peeling or fragmenting during the assembly process. Each layer 55 and 90, respectively, is folded under itself to prevent fraying of a free edge and to provide greater strap integrity. Further, netting material layer 80 and 82 have minimal thickness so that the overall profile of strap 40 remains slim and not visible beneath clothing. Alternatively, as shown in FIG. 5*b*, cup fabric 90 can be sewn to non-slip portion 55 and netting layer 80 without netting layer 82.

Figure 6:
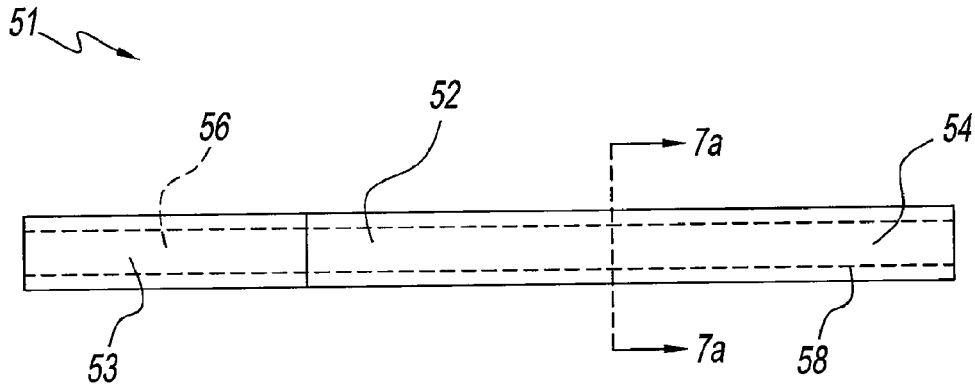
FIG. 6 illustrates a top view of the foam straps according to a second embodiment of the present invention having a straight configuration.

Referring to FIG. 6, a second embodiment of the brassiere strap of the present invention is shown and generally referenced using reference numeral 51. Strap 51 is similar to the strap of FIG. 2 and FIG. 3; however, strap 51 has a straight configuration. Strap 51 has a first surface 52 and a second surface 56. Surface 52, a skin contacting surface, has a non-slip portion 54 and a smooth portion 53. Non-slip portion 54 is also made from PORON™ to ensure that strap 51 does not slip on the shoulder of the wearer during wear. Other materials similar to PORON™ that offer a similar textured surface that would resist sliding on the shoulder of the wearer could also be used. Second surface 56 is a support surface of a brassiere cup to which non-slip portion 54 is connected, preferably, using stitches 58. Second surface 56 has a smooth profile to ensure a smooth appearance beneath clothing. Second surface 56 is made from a smooth fabric such as, for example, polyester, although other materials could also be used. Smooth portion 53 is also made from a smooth fabric, such as for example polyester.

Figure 7A:
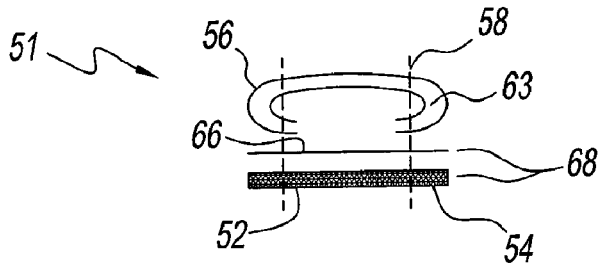
FIG. 7*a* illustrates a side cross-sectional view of the foam strap of FIG. 6 according to a second embodiment of the present invention, taken along line 7*a*-7*a;*
Figure 7B:
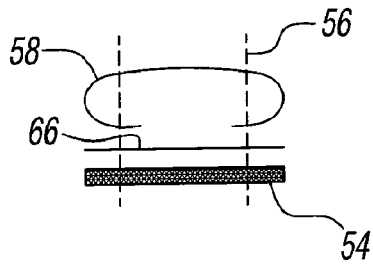
FIG. 7*b* illustrates a side cross-sectional view of the foam strap of FIG. 6 without a laminated layer.

FIG. 7*a* shows a cross-sectional view of the strap of FIG. 6. Second surface 56 of brassiere strap 51 has an inner netting material layer 63 connected thereto. Similarly, the inner side of non-slip layer 54 also has a netting material layer 66 such as for example, stabilized microfiber or stabilized tricot, connected thereto. Netting material layers 63 and 66 are preferably laminated to and inside the surface of second surface 52 and to the inner side of non-slip layer 54, respectively, prior to strap assembly. Netting layer 66 allows non-slip layer 54 to be sewn without peeling or fragmenting during the assembly process. Further, netting layers 63 and 66 have minimal thicknesses so that the overall profile of strap 51 remains slim and not visible beneath clothing. In the present embodiment, non-slip layer 54 is laminated to netting layer 66, and smooth portion 53 to form a straight configuration. Non-slip layer 54 and netting layer 66 have free ends 68 that are cut and are laminated together. By having free ends 68, strap 51 maintains a desirable thin profile beneath clothing. Were the edges folded over and sewn between the strap surfaces, strap 51 may potentially be visible beneath clothing. Further, the manufacturing of a straight strap is more efficient because the cutting and sewing processes are shorter and simpler. Alternatively, as shown in FIG. 7*b*, second surface 56 is sewn to non-slip portion 54 and netting layer 66 without netting layer 63.

Figure 8:
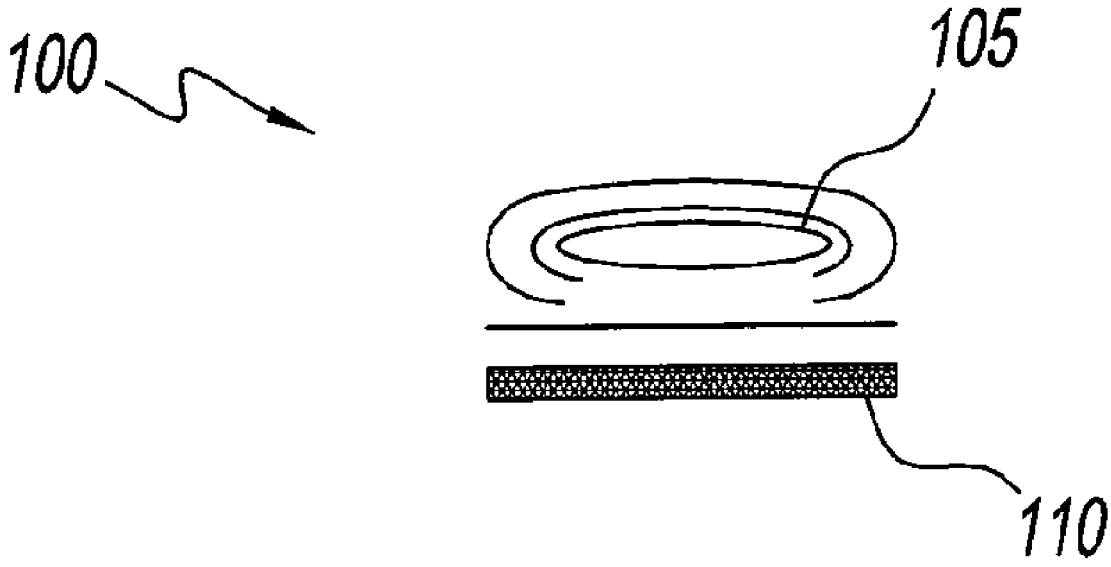
FIG. 8 illustrates a cross-sectional view of the foam strap of the third embodiment of the present invention having a comfort feature.

A third embodiment of the present invention is shown in FIG. 8. Strap 100 has a non-slip portion 110 and a comfort feature 105. Comfort feature 105 is preferably inserted in strap 100 during the assembly process. Comfort feature 105 can be a layer of for example, an encased silicone or gel material, a spacer fabric or a fiber fill insert. Comfort feature 105 allows the distribution of the weight of the breast tissue over the width of the strap 100 located at the top of the wearer's shoulder and minimizes the pressure of the breast tissue on the shoulder during wear. Comfort feature 105 together with non-slip portion 110 of PORON™ also offer a degree of compressibility and therefore comfort to the wearer of the brassiere incorporating such a strap 100. Comfort feature 105 can have either a straight or a curved configuration similar to the first and second embodiments shown in FIGS. 2 and 3 and FIGS. 6, 7*a*, and 7*b*, respectively.

Figure 10:
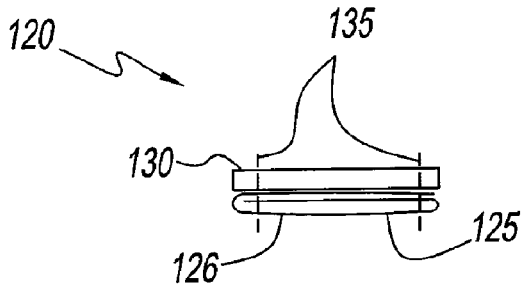
FIG. 10 illustrates a cross-sectional view of the fabric strap according to FIG. 9 taken along line 10-10.
Figure 9:
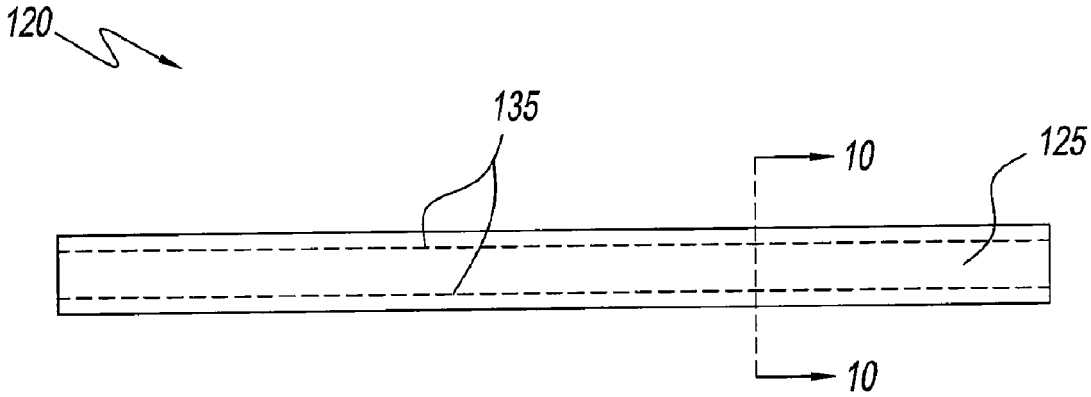
FIG. 9 illustrates a top view of a fabric strap according to a fourth embodiment of the present invention.

A fourth embodiment of the present invention, a non-slip strap is shown in FIGS. 9 and 10, and generally referred to using reference numeral 120. Strap 120 has a non-slip portion 125 that is knitted to enhance the friction between strap 120 and the skin of the shoulder of the wearer to prevent unwanted movement during wear. Strap 120 has a non-slip portion 125 that is knitted using an elasticized material that is plated towards its surface 126. By knitting the elasticized material to the surface 126, a nap is created to provide a gripping or friction effect between strap 120 and the skin of the wearer to prevent slipping. The material used to knit non-slip portion 125 is a blend of preferably approximately a 36% nylon and 64% Spandex blend material. Other similar percentages could also be used to provide the same function to prevent slipping between non-slip portion 125 and the skin of the wearer.

Strap 120 preferably has a straight configuration; although other configurations, such as an elongated ovoid shape, could also be used to enhance the functionality of strap 120. A strap having a narrower and/or straight configuration would coordinate with a delicate brassiere and still offer the non-slip function. The manufacturing of a straight strap is more efficient because the cutting and sewing processes are shorter and simpler. A strap having a thickness of between about 0.375 and 1.25 inches is sized to provide optimal performance. Non-slip portion 125 is connected to a base material 130 by stitches 135. Additionally, strap 120 could also include a comfort feature as shown in the second embodiment to provide additional comfort to the wearer.

The present invention has been described with particular reference to the preferred embodiment. It should be understood that the foregoing descriptions and examples are only illustrative of the present invention. Various alternatives and modifications thereof can be devised by those skilled in the art without departing from the spirit and scope of the present invention. Accordingly, the present invention is intended to embrace all such alternatives, modifications, and variations that fall within the scope of the disclosure.

I claim:

1. A shoulder strap for a brassiere having a pair of breast receiving cups, a torso-encircling band, and a shoulder strap extending between each breast receiving cup and the torso-encircling band, each shoulder strap comprising:

a layer of strap material having an inner surface with an inner surface area shape, opposed free side edges, and an outer non-slip foam surface for wear against the skin of a wearer;

a support fabric having an inner surface and overlying said inner surface of the layer of strap material, the inner surface of the support fabric corresponding to the inner surface area shape of the layer of strap material, and having opposed free side edges;

the opposed free side edges of the layer of strap material folded upwardly and inwardly adjacent the inner surface of the layer of strap material, and the opposed free side edges of the support fabric folded downwardly and inwardly adjacent the inner surface of the support fabric; and the folded free side edges of the layer of strap material and the support fabric all being stitched together to interconnect the layer of strap material to the support fabric to thereby form the brassiere shoulder strap.

2. The brassiere strap according to claim 1, wherein the shoulder strap so formed said has a straight configuration.

3. The brassiere strap according to claim 1, wherein the shoulder strap so formed has a curvilinear configuration.

4. The brassiere strap according to claim 3, wherein said curvilinear configuration is an elongated ovoid configuration.

5. The brassiere strap according to claim 1, wherein said foam is an open celled microcellular polyurethane that is a urethane polymer.

6. The brassiere strap according to claim 1, further comprising an insert between said inner surface and said support fabric.

7. The brassiere strap according to claim 6, wherein said insert consists of a material selected from the group consisting of silicone, spacer fabric or fiber fill.

8. A shoulder strap for a brassiere having a pair of breast receiving cups, a torso-encircling band, and a shoulder strap extending between a breast receiving cup and the torso-encircling band, each shoulder strap comprising:

a layer of strap material having an outer non-slip foam surface for wear against the skin of a wearer, and an inner surface area with an inner surface area shape opposite said non-slip foam surface, and opposed free side edges;

a support layer having an inner surface with an inner surface area shape overlying said inner surface of the layer of strap material, the inner surface area shape of the support layer corresponding to the inner surface area shape of the layer of strap material, and having opposed free side edges;

the opposed free side edges of the layer of strap material folded upwardly and inwardly adjacent the inner surface of the layer of strap material, and the opposed free side edges of the support layer folded downwardly and inwardly adjacent the inner surface of the support layer; and the folded free side edges of the layer of strap material and the support layer all being stitched together to interconnect the layer of strap material to the support layer to thereby form said brassiere shoulder strap.

9. The brassiere strap according to claim 8, further comprising a first layer of fabric laminated to said inner surface of the layer of material and a second layer of fabric laminated to said inner surface of the support layer proximate said first layer.

10. The brassiere strap according to claim 8, wherein the shoulder strap so formed has a straight configuration.

11. The brassiere strap according to claim 8, wherein the shoulder strap so formed has a curvilinear configuration.

12. The brassiere strap according to claim 11, wherein said curvilinear configuration is an elongated ovoid configuration.

13. The brassiere strap according to claim 8, wherein said foam is an open celled microcellular polyurethane that is a urethane polymer.

14. The brassiere strap according to claim 8, further comprising an insert between said inner surface and said support fabric.

15. The brassiere strap according to claim 14, wherein said insert consists of a material selected from the group consisting of silicone, spacer fabric or fiber fill.

16. The brassiere strap according to claim 8, wherein said layer having a non-slip foam surface, said support layer and said first layer of fabric and said second layer of fabric are stitched together.

17. The brassiere strap according to claim 9, wherein said layer having a non-slip foam surface and said first layer of fabric laminated to said inner surface each comprise free-ends at opposite sides thereof.

* * * * *